US009033567B2

(12) United States Patent
Ye et al.

(10) Patent No.: US 9,033,567 B2
(45) Date of Patent: May 19, 2015

(54) BACKLIGHT ASSEMBLY

(71) Applicant: SAMSUNG DISPLAY CO., LTD., Yongin, Gyeonggi-Do (KR)

(72) Inventors: Byoung Dae Ye, Yongin-si (KR); Myung-Seok Kwon, Seongnam-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 74 days.

(21) Appl. No.: 13/736,225

(22) Filed: Jan. 8, 2013

(65) Prior Publication Data

US 2014/0049982 A1 Feb. 20, 2014

(30) Foreign Application Priority Data

Aug. 20, 2012 (KR) ..... 10-2012-0090651

(51) Int. Cl.

| | |
|---|---|
| ***F21V 7/04*** | (2006.01) |
| ***G09F 13/18*** | (2006.01) |
| *G09F 13/04* | (2006.01) |

(52) U.S. Cl.

CPC ..... *G09F 13/18* (2013.01); *G09F 2013/049* (2013.01)

(58) Field of Classification Search

CPC .. G02B 6/0093; G02B 6/0043; G02B 6/0086; G02F 1/133608; G02F 2001/133322; G02F 2001/133317; G02F 2201/46

USPC ..... 362/632–634

See application file for complete search history.

(56) References Cited

U.S. PATENT DOCUMENTS

| | | | | |
|---|---|---|---|---|
| 2008/0088763 | A1* | 4/2008 | Toriyama et al. | 349/58 |
| 2009/0137073 | A1* | 5/2009 | Park et al. | 438/27 |
| 2010/0128465 | A1 | 5/2010 | Byoun et al. | |
| 2010/0165235 | A1 | 7/2010 | Lee et al. | |

FOREIGN PATENT DOCUMENTS

| | | | |
|---|---|---|---|
| JP | 2005-135860 | A | 5/2005 |
| KR | 1020060085369 | A | 7/2006 |
| KR | 1020080002652 | A | 1/2008 |
| KR | 1020100077482 | A | 7/2010 |
| KR | 101006838 | A | 1/2011 |
| KR | 1020110000200 | A | 1/2011 |
| KR | 101079749 | B1 | 10/2011 |
| KR | 1020110132152 | A | 12/2011 |
| KR | 1020120007292 | A | 1/2012 |

* cited by examiner

*Primary Examiner* — William Carter

(74) *Attorney, Agent, or Firm* — Cantor Colburn LLP

(57) ABSTRACT

A backlight assembly includes: a light guide; a light source at one side of the light guide and separated from the light guide; a circuit board on which the light source is mounted; and a buffer member between the light guide and the circuit board. An opening is defined in the buffer member and exposes the light source.

20 Claims, 5 Drawing Sheets

BACKLIGHT ASSEMBLY

This application claims priority to Korean Patent Application No. 10-2012-0090651 filed on Aug. 20, 2012. and all the benefits accruing therefrom under 35 U.S.C. §119. the entire contents of which are incorporated herein by reference.

BACKGROUND (a) Field

The invention relates to a backlight assembly. More particularly, the invention relates to a backlight assembly where influence on a light source by deformation of a light guide is reduced or effectively prevented.

(b) Description of the Related Art

A computer monitor, a television, a mobile phone and the like that are widely used need a display device to display an image thereon. Examples of the display device include a cathode ray tube display device, a liquid crystal display device and a plasma display device.

The liquid crystal display device as one of flat panel display devices that are widely used includes a display panel including two substrates. The substrates include field generating electrodes such as a pixel electrode and a common electrode, with a liquid crystal layer interposed therebetween. The liquid crystal display device generates an electric field in the liquid crystal layer by applying voltages to the field generating electrodes to determine alignment of liquid crystal molecules of the liquid crystal layer and control polarization of incident light, thereby displaying an image.

Since the liquid crystal display device is not a self-luminous device, the liquid crystal display device includes a light source to generate and supply light to the display panel. The light source may be a separately mounted artificial light source or may be natural light. Examples of the artificial light source used in the liquid crystal display device include a light emitting diode ("LED"), a cold cathode fluorescent lamp ("CCFL") and an external electrode fluorescent lamp ("EEFL").

In order for light emitted from the artificial light source to reach an entire of the display panel with uniform luminance, the liquid crystal display device includes a light guide such as a light guide plate ("LGP").

When the LGP is positioned close to the light source and the liquid crystal display device is used for a relatively long time, deformation of the LGP may be undesirably generated by heat transmitted from the light source. Also, the deformed LGP may apply pressure to the light source, and the light source may thereby be damaged.

A buffer member may be between the LGP and the light source to reduce or effectively prevent pressure to the light source from the LGP. However, in spite of the buffer member between the LGP and the light source, the light source may still be pressed due to the deformation of the LGP. Also, while light emitted from the light source passes through the buffer member, diffraction of the light is generated such that a path of incident light to the display panel may be undesirably changed. Therefore, there exists a need for an improved display device where influence on a light source from deformed elements such as a LGP is reduced or effectively prevented.

SUMMARY

One or more exemplary embodiment of the invention provides a backlight assembly in which influence on a light source by deformation of a light guide is reduced or effectively prevented.

Also, one or more exemplary embodiment provides a backlight assembly in which a change to a path of incident light between a light source and a light guide is reduced or effectively prevented, such that incident light efficiency is increased.

An exemplary embodiment of a backlight assembly according to the invention: includes a light guide; a light source at a side of the light guide and separated from the light guide; a circuit board including the light source mounted thereon; and a buffer member between the light guide and the circuit board. An opening is defined in the buffer member and exposes the light source.

The buffer member may be ladder-shaped.

The buffer member may include: a bar-shaped first supporting unit; a bar-shaped second supporting unit parallel to the first supporting unit; and a plurality of connections connecting the first supporting unit and the second supporting unit.

The opening may be defined by the first supporting unit, the second supporting unit and the connections.

The connections may protrude further from the circuit board than the light source.

A thickness of the connections may be greater than a thickness of the light source.

An upper surface of the circuit board may include an upper part, a center part and a lower part, and the light source may be mounted at the center part of the upper surface of the circuit board.

The first supporting unit may be fixed to the upper part of the upper surface of the circuit board, and the second supporting unit may be fixed to the lower part of the upper surface of the circuit board.

The light source generates and emits light, and the light emitted from the light source may be incident to the side of the light guide.

The light source may be disposed to face the side of the light guide.

The backlight assembly may further include a plurality of light sources, and the plurality of light sources may be disposed at predetermined intervals.

The backlight assembly may further include a plurality of openings defined in the buffer member, and the plurality of openings may be disposed at the predetermined intervals to expose the plurality of light sources.

The buffer member may include a soft or flexible material.

The buffer member may include a silicon material.

The buffer member may include a reflective material.

The light source may include a light emitting diode ("LED").

The backlight assembly may further include a reflector under the light guide.

One or more exemplary embodiment of the backlight assembly according to the invention has effects as follows.

In one or more exemplary embodiment of the backlight assembly according to the invention, the buffer member is between the circuit board on which the light source is mounted, and the light guide, and an opening is defined in the buffer member to expose the light source. Even if the light guide is deformed, the light source may not be influenced by such deformation.

A distance between the light source and the light guide may be defined such that light emitted from the light source is incident to the light guide and a change of the path of incident light may be reduced or effectively prevented.

Also, the buffer member includes a reflective material such that the light that is not incident to the light guide or the light emitted from the light guide, is reflected back toward the light guide by the buffer member such that the incident light efficiency may be increased.

BRIEF DESCRIPTION OF THE DRAWINGS

The above and other features of this disclosure will become more apparent by describing in further detail exemplary embodiments thereof with reference to the accompanying drawings, in which.

DETAILED DESCRIPTION

Figure 1:
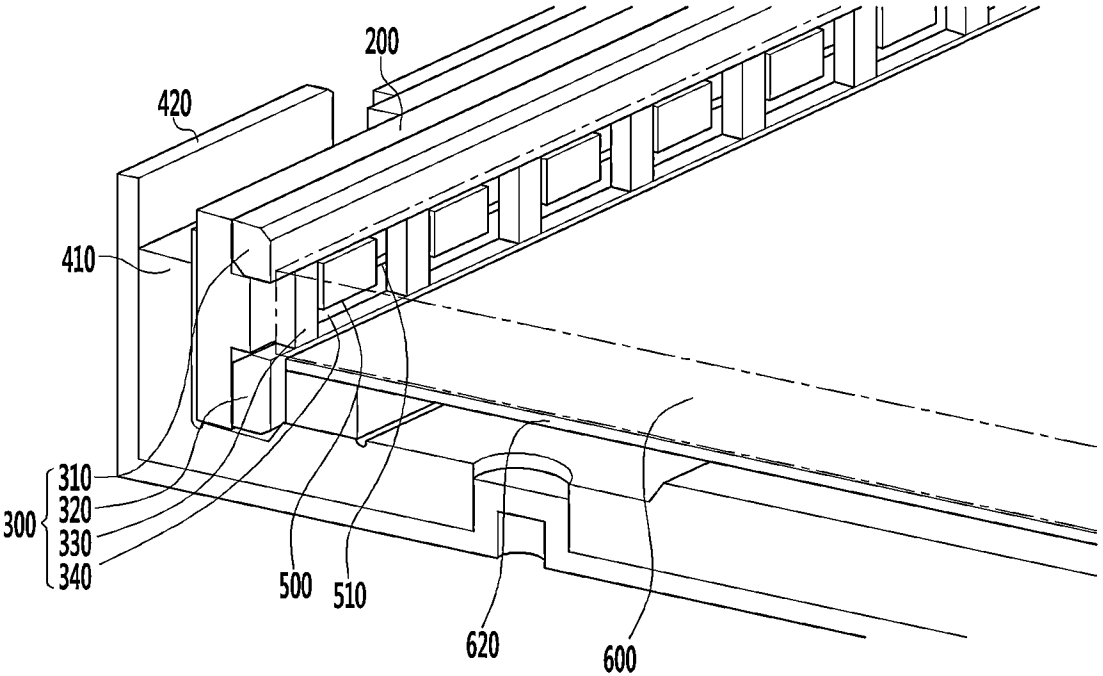
FIG. 1 is a partially cut-away perspective view of an exemplary embodiment of a region of a backlight assembly according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

In the drawings, the thickness of layers, films, panels, regions, etc., are exaggerated for clarity. Like reference numerals designate like elements throughout the specification. As used herein, the term "and/or" includes any and all combinations of one or more of the associated listed items. It will be understood that when an element such as a layer, film, region, or substrate is referred to as being "on" another element, it can be directly on the other element or intervening elements may also be present. In contrast, when an element is referred to as being "directly on" another element, there are no intervening elements present.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" or "under" relative to other elements or features would then be oriented "above" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used in this specification, specify the presence of stated features, integers, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be described in detail with reference to the accompanying drawings.

Firstly, a backlight assembly according to an exemplary embodiment of the invention will be described with reference to accompanying drawings.

Figure 2:
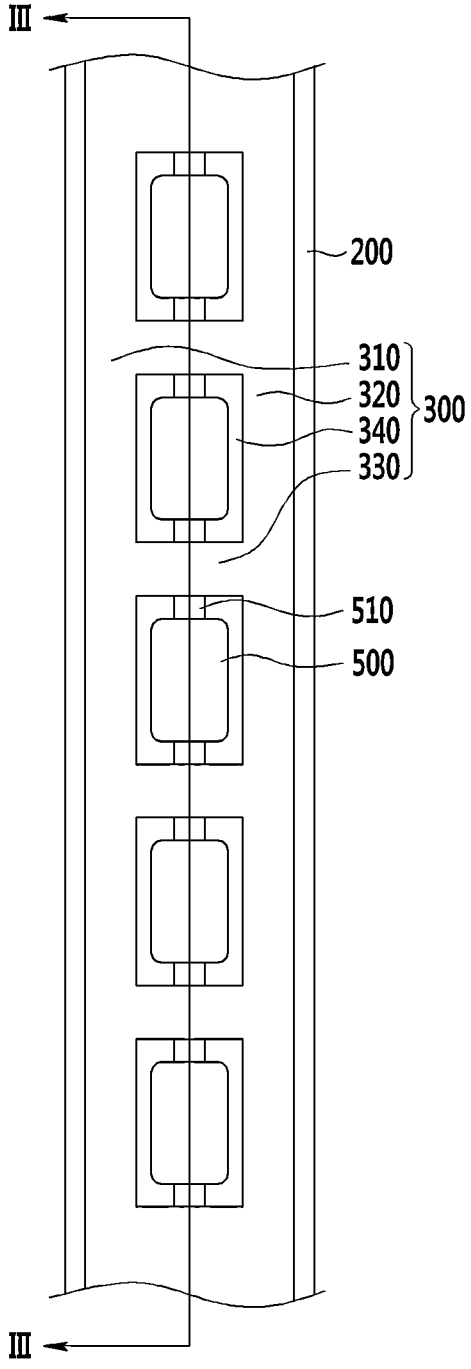
FIG. 2 is a top plan view of an exemplary embodiment of a light source, a circuit board and a buffer member of a backlight assembly according to the invention.
Figure 3:
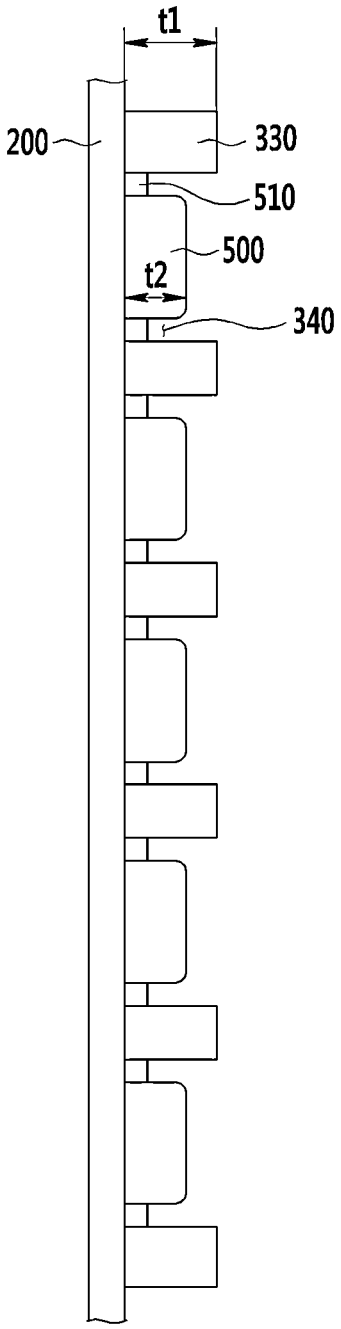
FIG. 3 is a cross-sectional view of the light source, the circuit board and the buffer member of the backlight assembly taken along line III-III of FIG. 2.

FIG. 1 is a partially cut-away perspective view of an exemplary embodiment of a region of a backlight assembly according to the invention, FIG. 2 is a top plan view of an exemplary embodiment of a light source, a circuit board and a buffer member of a backlight assembly according to the invention, and FIG. 3 is a cross-sectional view of the light source, the circuit board and the buffer member of the backlight assembly taken along line III-Ill of FIG. 2.

An exemplary embodiment of a backlight assembly according to the invention includes a light guide 600, a light source 500 positioned at a side of the light guide 600, a circuit board 200 upon which the light source 500 is mounted, and a buffer member 300 between the light guide 600 and the circuit board 200.

The light guide 600 uniformly transfers light generated and emitted from the light source 500 to an entire surface of a display panel (not shown) of a display device. The light guide 600 may include an injected material, such as an acrylic injected material. Although not shown, the display panel is on the backlight assembly thereby forming the display device. The display panel may be on the light guide 600, and the light guide 600 uniformly emits light incident to the side through an entire upper surface thereof, thereby uniformly transmitting the light to the display panel. The side of the light guide 600 may be an incident side surface where the upper surface may be a light exiting (or emitting) surface.

The light source 500 is separated from the light guide 600 and disposed at the side of the light guide 600. For the light emitted from the light source 500 to be incident to the side of the light guide 600, a main emission direction of the light source 500 is directed toward the side of the light guide 600. That is, the light source 500 is disposed to face the side of the light guide 600.

As described above, the light source 500 is at one side of the light guide 600, however, the invention is not limited thereto, and the light source 500 may be at each of two facing sides of the light guide 600. Where the light source 500 is at each of the two facing sides of the light guide 600, the light emitted from the light source 500 is incident to both of these facing sides of the light guide 600. Also, the light guide 600 may have four sides, and the light source 500 may be at all four sides.

The light source 500, for example, may include a light emitting diode ("LED"). The backlight assembly may include a plurality of light sources 500 and the plurality of light sources 500 may be disposed at predetermined intervals along the side of the light guide 600. However, the invention is not limited thereto, and the plurality of light sources 500 may be disposed at irregular intervals.

The circuit board 200 may include a printed circuit board ("PCB"). The PCB may include a substrate of which during a manufacturing process thereof, a copper thin film initially covers an insulating plate and an unnecessary portion of the copper thin film is removed according to a circuit diagram, to form an electronic circuit of the PCB. The light source 500 is mounted on the circuit board 200, and a plurality of light sources 500 are connected by wires 510. All of the light sources 500 may be connected to each other as one single group by the wires 510, or the light sources 500 may be connected to each other as a plurality of groups by the wires 510. In one exemplary embodiment, for example, a same signal may be applied for a group of three light sources 500 and the group of three light sources 500 may be connected by the wires 510. Each light source 500 may receive a signal through the wires 510 to drive the light source 500.

The buffer member 300 is between the light guide 600 and the circuit board 200. An opening 340 exposing the light source 500 is defined in the buffer member 300. For a plurality of light sources 500, a plurality of openings 340 exposing the light sources 500 may be defined in the buffer member 300. Where a plurality of openings 340 is defined in the buffer member 300, the buffer member 300 may have a ladder shape.

The buffer member 300 includes a first supporting unit 310 and a second supporting unit 320 of a bar shape, and a plurality of connections 330 connecting the first supporting unit 310 and the second supporting unit 320. The first supporting unit 310 and the second supporting unit 320 are separated from and parallel to each other. The opening 340 is enclosed by the first supporting unit 310, the second supporting unit 320 and adjacent connections 330. Along with the first and second supporting units 310 and 320, for example, two connections 330 define one opening 340 and three connections 330 define two openings 340. In FIG. 1, along with the first and second supporting units 310 and 320, seven connections 330 define six openings 340. However, a number of the openings 340 may be variously changed.

For a plurality of light sources 500, a plurality of openings 340 may be defined in the buffer member 300. If the plurality of light sources 500 are disposed at predetermined intervals, the plurality of openings 340 may also be disposed at predetermined intervals while exposing the plurality of light sources 500, respectively.

One light source 500 may be disposed in and exposed by one opening 340, such as in a one-to-one correspondence. However, the invention is not limited thereto, and a plurality of light sources 500 may be disposed in and exposed by one single opening 340.

The buffer member 300 may include a flexible material. In one exemplary embodiment, for example, the buffer member 300 may include a silicon material. Due to the flexible material, the buffer member 300 may be compressed from an original state thereof by deformation of the light guide 600 and thereafter may return to the original state. When heat is continuously applied to the light guide 600 such as to cause the light guide 600 to sag, the buffer member 300 is pressed by the sagged light guide 600 such that the buffer member 300 may be compressed. Also, when the light guide 600 is returned back to the original state, pressure applied to the buffer member 300 from the light guide 600 is decreased or disappears, and the buffer member 300 may return to the original state thereof.

The buffer member 300 may include a reflective material. In one exemplary embodiment, for example, the buffer member 300 may include a white silicon material. A portion of the light emitted from the light source 500 may not be incident to the light guide 600. The light that is not incident to the light guide 600 is reflected by the buffer member 300 including the reflective material and may then be incident to the light guide 600. That is, by the buffer member 300 including the reflective material, an amount of the light incident to the light guide 600 may be increased.

Next, a combination of the circuit board 200 and the buffer member 300 will be described.

The light source 500 may be mounted at an upper surface of the circuit board 200, and the upper surface of the circuit board 200 may include an upper part, a center part and a lower part. In FIG. 1, the upper surface of the circuit board 200 faces the light guide 600. The upper part of the upper surface is positioned higher than the light guide 600, such as facing the first supporting unit 310 of the buffer member 300. The lower part of the upper surface is positioned lower than the light guide 600, such as facing the second supporting unit 320 of the buffer member 300. The center part of the upper surface is positioned between the upper part and the lower part.

FIG. 2 is a plane view facing the upper surface of the circuit board 200. A portion of the upper and lower parts of the upper surface of the circuit board 200 is exposed from the buffer member 300, but is not limited thereto or thereby. In FIG. 2, the upper part is positioned at the left side of the drawing, and the lower part is positioned at the right side of the drawing. The center part of the upper surface of the buffer member 300 may protrude further than the upper and lower parts of the upper surface, as illustrated in FIG. 1, but is not limited thereto or thereby. In an exemplary embodiment, the lower, center and upper parts of the upper surface of the buffer member 300 may be coplanar with each other.

The light source 500 may be mounted at the center part of the upper surface of the circuit board 200. The first supporting unit 310 of the buffer member 300 may be fixed to the upper part of the upper surface of the circuit board 200, the second supporting unit 320 of the buffer member 300 may be fixed to the lower part of the upper surface of the circuit board 200, and the connections 330 of the buffer member 300 may be fixed to the center part of the upper surface of the circuit board 200. The backlight assembly may further include an adhering member (not shown) between the buffer member 300 and the circuit board 200 to fix the buffer member 300 to the circuit board 200. In one exemplary embodiment, for example, the adhering member may be a double-sided adhesive tape, but is not limited thereto or thereby. As described above, the first supporting unit 310, the second supporting unit 320 and the connections 330 of the buffer member 300 are all fixed to the circuit board 200, however, the invention is not limited thereto. In alternative exemplary embodiments, only a portion of the first supporting unit 310, the second supporting unit 320 and/or the connections 330 of the buffer member 300 may be fixed to the circuit board 200. Also, none of the buffer member 300 may be fixed to the circuit board 200.

If the buffer member 300 and the light guide 600 contact each other, the buffer member 300 may contact the circuit board 200 without an additional adhering means. That is, if the buffer member 300 is disposed between the circuit board 200 and the light guide 600 without a space therebetween, lifting of the buffer member 300 from the circuit board 200 may be reduced or effectively prevented.

Hereinafter, a thickness of the light source 500 and the buffer member 300 will be described.

Referring to FIG. 3, a thickness t1 of the connections 330 of the buffer member 300 is greater than the thickness t2 of the light source 500. That is, the connections 330 of the buffer member 300 protrude further from a common plane of the circuit board 200 than the light source 500.

By this structure, the connections 330 of the buffer member 300 may contact the light guide 600, however, the light source 500 does not contact the light guide 600. As heat is continuously applied to the light guide 600, the light guide 600 may be deformed, and the connections 330 of the buffer member 300 may be deformed by the deformation of the light guide 600. As the light guide 600 is deformed, pressure is applied to the buffer member 300 such that the buffer member 300 is compressed. Accordingly, as the buffer member 300 is compressed, the thickness t1 of the buffer member 300 is decreased. Based on a maximum value of the thickness t2 of the light source 500 in consideration of a minimum thickness of the compressed buffer member 300, even though the deformation of the light guide 600 is generated, the side of the light guide 600 may not contact the light source 500. That is, the uncompressed thickness t1 of the buffer member 300 is sufficiently large such that the light source 500 may not be influenced by the deformation of the light guide 600.

Again referring to FIG. 1, an exemplary embodiment of a backlight assembly according to the invention may further include a reflector 620.

The reflector 620 changes a path of light toward the direction of the display panel such that the light emitted from the light source 500 is not lost. That is, when the light emitted from the light source 500 is output to the lower surface of the light guide 600, the reflector 620 reflects the light such that the light is again incident to the light guide 600 in a direction towards the display panel.

Also, the exemplary embodiment of the backlight assembly according to the invention may be fixed to an assistance chassis 410. A lower chassis 420 may be fixed to and/or enclose the assistance chassis 410.

The assistance chassis 410 may include a bottom surface, and a side surface connected to the bottom surface. The circuit board 200 of the backlight assembly may be fixed to the side surface of the assistance chassis 410. The circuit board 200 may be fixed to the assistance chassis 410 by an adhering member or a fastening member such as a screw, but is not limited thereto or thereby.

The lower chassis 420 may enclose the assistance chassis 410 and the backlight assembly, thereby having a function of protecting the backlight assembly.

Although not shown, as described above, the display panel is on the light guide thereby forming the display device.

The display panel includes two substrates facing each other, and a liquid crystal layer (not shown) is between the two substrates. A gate line and a data line, and a thin film transistor connected to the gate and data lines are on one of the two substrates. The display panel may include a plurality of gate lines, data lines and/or thin film transistors. Also, the display panel includes a pixel electrode applied with a signal transmitted from the data line when the thin film transistor is turned on by a signal transmitted from the gate line. The display panel may further include a common electrode on one of the two substrates, and an electric field is formed between the pixel electrode and the common electrode to control alignment of liquid crystal molecules of the liquid crystal layer. Accordingly, the light incident to the display panel is controlled, thereby displaying an image thereon.

In the above exemplary embodiments, the display panel is a liquid crystal display panel, however the invention is not limited thereto, and various display panels such as an electrophoretic display panel ("EDP") may be used.

Also, an edge of the display panel may be covered by an upper chassis(not shown), and the upper chassis may be fixed to the lower chassis 420.

Next, referring to FIG. 4, incident light efficiency of a backlight assembly according to an exemplary embodiment of the invention will be described.

Figure 4:
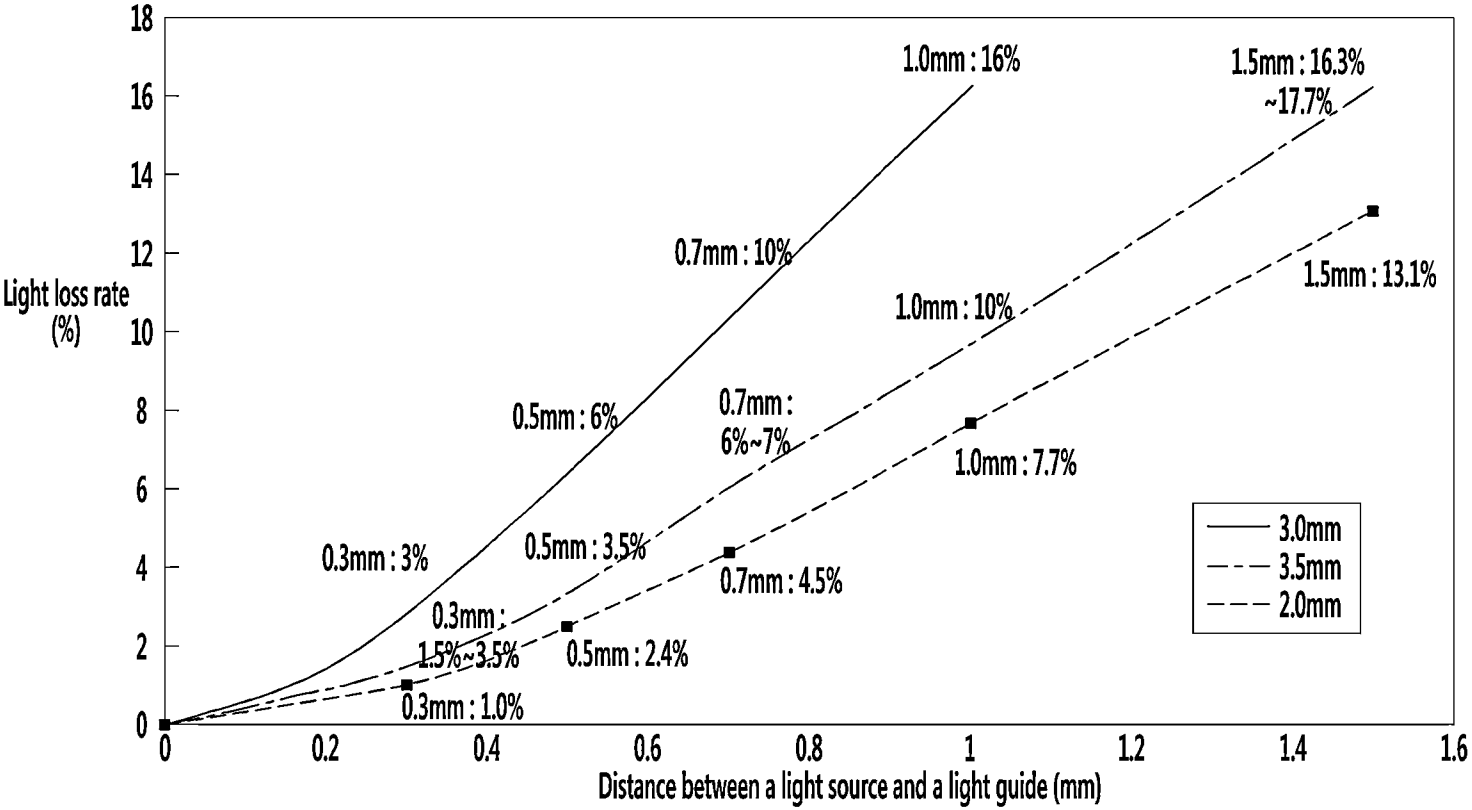
FIG. 4 is a graph showing a light loss rate in percent (%) according to a distance in millimeters (mm) between a light source and a light guide in exemplary embodiments of a backlight assembly according to the invention.

FIG. 4 is a graph showing a light loss rate in percent (%) according to a distance in millimeters (mm) between a light source and a light guide in exemplary embodiments of a backlight assembly according to the invention. In FIG. 4, a thickness of the light guide in the backlight assemblies, respectively, is 3.0 mm, 3.5 mm, and 2.0 mm.

As a distance between the light source and the light guide is increased, the light loss rate is increased. If the light source and the light guide contact each other, most of the light emitted from the light source is incident to the light guide. Differently from this, if the light source and the light guide are separated from each other, the light is partially incident toward the upper side and the lower side of the light guide. Light that goes straight from the light source toward the light guide is incident to the light guide, however, light emitted at predetermined angle from the light source may not be incident to the light guide. As the distance between the light source and the light guide is increased, an amount of the light that is not incident to the light guide is increased. That is, as the distance between the light source and the light guide is decreased, the amount of the light incident to the light guide is increased, thereby increasing the incident light efficiency of the backlight assembly.

In the exemplary embodiment of the backlight assembly according to the invention, the buffer member reduces or effectively prevents damage to the light source by the deformation of the light guide. Accordingly, the distance between the light source and the light guide within a backlight assembly may be minimized, thereby reducing the light loss rate. If a conventional backlight assembly excludes the buffer member which reduces or effectively prevents damage to the light source due to the deformation of the light guide, the light source and the light guide are separated by a space which increases a distance between the light source and the light guide, such that the light loss rate is undesirably increased. In contrast to the conventional backlight assembly, in the exemplary embodiment of the backlight assembly according to the invention, the space between the light source and the light guide is minimized and the light source and the light guide are sufficiently close to each other, thereby increasing the incident light efficiency of the backlight assembly.

Also, in an exemplary embodiment of the backlight assembly according to the invention, the buffer member includes the reflective material such that the light emitted from the light source at the predetermined angle is reflected by the buffer member and is then incident into the light guide, thereby further increasing the incident light efficiency of the backlight assembly.

Next, referring to FIG. 5, a characteristic of a light source not influenced by a deformation of a light guide in an exemplary embodiment of a backlight assembly according to the invention will be described.

Figure 5:
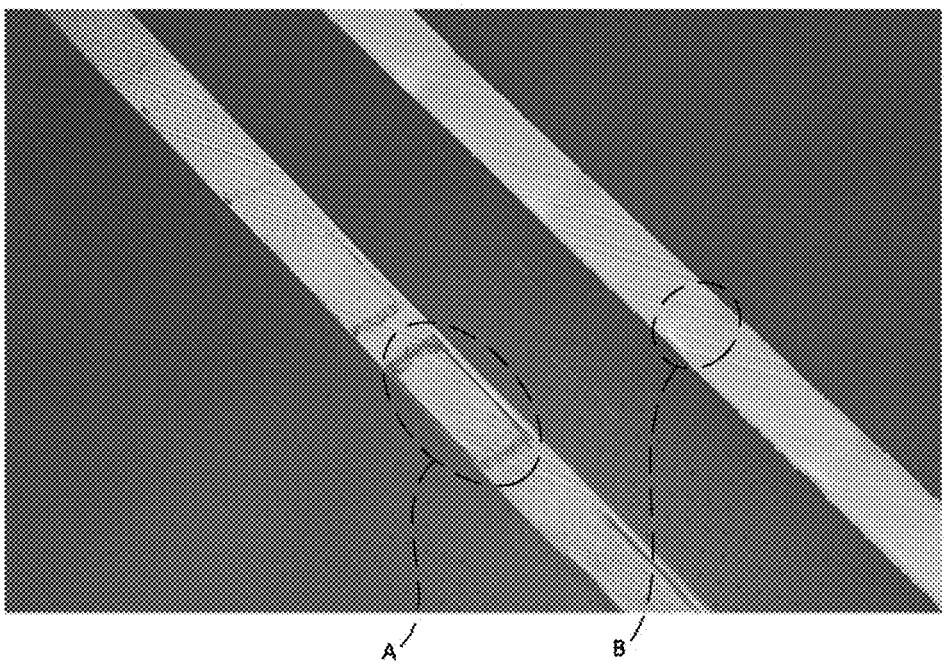
FIG. 5 is a photograph showing an incident light surface of a deformed light guide in an exemplary embodiment of a backlight assembly according to the invention along with a comparative example.

FIG. 5 is a photograph showing an incident light surface of a deformed light guide in an exemplary embodiment of a backlight assembly according to the invention along with a comparative example. In a plan view of the incident light surfaces, the incident light surfaces are shown as two bar shapes. The left bar-shaped incident light surface 'A' in FIG. 5 is the comparative example, and the right bar-shaped incident light surface 'B' is the exemplary embodiment of the invention.

The comparative example has a structure in which the backlight assembly excludes an exemplary embodiment of a buffer member according to the invention. When the buffer member is excluded, as the heat is continuously applied to the light guide, the light guide is deformed such that the light guide may contact the light source. The light guide may apply pressure to the light source such that a trace artifact due to the contact of the light source to the light guide remains on the incident light surface. If the deformation of the light guide is serious, the light source may be damaged.

In contrast, the exemplary embodiment of the backlight assembly according to the invention includes a buffer member. If the light guide is deformed and expanded in the exemplary embodiment of the backlight assembly, the light guide contacts the buffer member. When the light guide applies pressure to the buffer member, a trace where the buffer member contacts the light guide may be observed. However, in the exemplary embodiment of the backlight assembly, the light guide only applies pressure to the buffer member, but does not contact the light source such that the light source is not damaged. That is, the light source is not influenced by the deformation of the light guide.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A backlight assembly comprising:

a light guide;

a light source at a side of the light guide and separated from the light guide;

a circuit board comprising the light source on an upper surface thereof, and a protruded portion extended from the upper surface; and a ladder-shaped buffer member between the light guide and the circuit board, wherein an opening is defined in the buffer member and exposes the light source, the protruded portion of the circuit board is engaged with the buffer member, and the buffer member contacts the light guide.

2. The backlight assembly of claim 1, wherein the buffer member comprises:

a bar-shaped first supporting unit;

a bar-shaped second supporting unit parallel to the first supporting unit; and a plurality of connections which connects the first supporting unit and the second supporting unit to each other.

3. The backlight assembly of claim 2, wherein the opening is defined by the first supporting unit, the second supporting unit and the plurality of connections.

4. The backlight assembly of claim 3, wherein the plurality of connections protrude further toward the light guide from the circuit board than the light source.

5. The backlight assembly of claim 3, wherein a thickness of the plurality of connections is greater than a thickness of the light source, in a direction from the circuit board to the light guide.

6. The backlight assembly of claim 3, wherein the upper surface of the circuit board comprises an upper part, a center part and a lower part, and the light source is at the center part of the upper surface of the circuit board.

7. The backlight assembly of claim 6, wherein the first supporting unit is fixed to the upper part of the upper surface of the circuit board, and the second supporting unit is fixed to the lower part of the upper surface of the circuit board.

8. The backlight assembly of claim 6, wherein the light source generates and emits light, and the light emitted from the light source is incident to the side of the light guide.

9. The backlight assembly of claim 8, wherein the light source faces the side of the light guide.

10. The backlight assembly of claim 2, wherein the first supporting unit and the second supporting unit of the buffer member are respectively disposed at an upper part and a lower part of the circuit board upper surface, and the upper surface upper and lower parts respectively extend further than the buffer member first and second supporting units.

11. The backlight assembly of claim 1, further comprising a plurality of light sources, and the plurality of light sources is spaced at predetermined intervals.

12. The backlight assembly of claim 11, further comprising a plurality of openings defined in the buffer member, and the plurality of openings is spaced at the predetermined intervals and exposes the plurality of light sources.

13. The backlight assembly of claim 1, wherein the buffer member comprises a flexible material.

14. The backlight assembly of claim 13, wherein the buffer member comprises a silicon material.

15. The backlight assembly of claim 14, wherein the buffer member comprises a reflective material.

16. The backlight assembly of claim 1, wherein the light source comprises a light emitting diode.

17. The backlight assembly of claim 1, further comprising a reflector under the light guide.

18. A method of manufacturing a backlight assembly, the method comprising:

providing a light guide which guides light and comprises a light incident surface;

providing a light source which generates and emits light, on an upper surface of a circuit board comprising a protruded portion extended from the upper surface, wherein the light source faces and is separated from the light incident surface of the light guide; and providing a ladder-shaped buffer member between the circuit board and the light incident surface of the light guide, wherein an opening is defined in the buffer member and exposes the light source, the protruded portion of the circuit board is engaged with the buffer member; and the buffer member contacts the light guide.

19. The method of claim 18, wherein an upper surface of the buffer member is closer to the light incident surface of the light guide than an upper surface of the light source.

20. The method of claim 18, wherein the buffer member comprises a flexible material.

* * * * *